United States Patent [19]

Lerch et al.

[11] Patent Number: 4,586,448

[45] Date of Patent: May 6, 1986

[54] SEWING MACHINE

[75] Inventors: Hansueli Lerch; Otmar Stillhard, both of Steckborn, Switzerland

[73] Assignee: Fritz Gegauf AG Bernina-Nahmaschinenfabrik, Steckborn, Switzerland

[21] Appl. No.: 545,186

[22] Filed: Oct. 25, 1983

[30] Foreign Application Priority Data

Nov. 24, 1982 [CH] Switzerland ..... 6844/82

[51] Int. Cl.[4] ..... D05B 69/22

[52] U.S. Cl. ..... 112/275

[58] Field of Search ..... 112/275, 277, 220, 67, 112/87

[56] References Cited

U.S. PATENT DOCUMENTS 3,636,902 1/1972 Matsubara et al. ..... 112/275

4,173,193 11/1979 Morinaga et al. ..... 112/275

*Primary Examiner*—Peter Nerbun

*Attorney, Agent, or Firm*—Wender Murase & White

[57] ABSTRACT

A foot control of the sewing machine can be actuated from a neutral position in two directions. In one case, a variable resistance becomes effective which produces regulating voltages within a determined range. A logic circuit with comparators produces for this voltage range a condition in which the driving motor of the sewing machine is controlled to operate with a number of turns corresponding to the voltage range. When the machine is stopped the needle is automatically positioned in its upper stop position. By repetitive actuation backward of the foot pedal the needle may be positioned in its bottom stop position and again in its upper stop position and so on. The logic treatment of the control signals from the foot control permits to transmit these signals for all required instructions through a two wire cable which is already required for the speed control.

22 Claims, 7 Drawing Figures

SEWING MACHINE

BACKGROUND OF THE INVENTION

The present invention relates generally to sewing machines having an electric drive and a foot control for regulating the sewing speed and for selecting at least one needle stop position and more specifically to sewing machines wherein the foot control has a range of regulation for which regulating signals for determining the sewing speed are produced, and an off position for which a switch off signal, different from the regulating signals, is produced. A receiver for these signals is provided, which when it receives an off signal, operates to control the needle in one of the stop positions.

Such a sewing machine is described in PCT-Application WO No. 82/03 879. This known machine is relatively simple because it is provided with an usual foot control with a variable resistance and a circuit breaker at one of its end positions. However, the foot control described has an important drawback in that to reverse the position of the needle between its upper stop position, which it assumes automatically when the machine is stopped, and the bottom stop position, or from the bottom stop position to the upper stop position, the foot control must be brought into its control position for only a short time interval. Such position reversals are difficult, particularly for unpracticed persons.

It is therefore an object of the present invention to produce and to transmit additional control signals between a foot control and a sewing machine. It is a further object of the present invention to simplify a control for a sewing machine and to provide a more versatile sewing machine control.

SUMMARY OF THE INVENTION

In accordance with the present invention a foot control is provided which is commutable between at least one control position in which it produces a control signal, different from regulating signals and a switch off signal. Preferably a receiver associated with the foot control, comprises at least two logic input circuits which define at least three determined logic conditions, each logic condition determining a function. Advantageously, only a two wire connection for the transmission of all signals is necessary between the foot control and the receiver.

With at least three logic conditions e.g. 1/1, 1/0, 0/0, the input circuits of the receiver can control well determined functions of the machine without the requirement of having to maintain a determined sequence of these functions or of having to activate, for a short time interval, the foot control for releasing a determined function.

Preferably a foot control is provided comprising a means for holding a pedal in a control stopping position and for permitting a horizontal swing of the pedal in a forward direction to switch on a variable resistance for producing a regulating signal, or in a backward direction into a control position for producing the control signal. The pedal may work on a slide with brushes which may run from the stopping position at one side upon layers of a variable resistance and at the other side on contacts for closing a control circuit.

BRIEF DESCRIPTION OF THE DRAWINGS

The invention will be described further by means of an example and with reference to the accompanying drawings in which similar elements are identified with the same numerals and in which.

DESCRIPTION OF THE PREFERRED EMBODIMENTS

Figure 1:
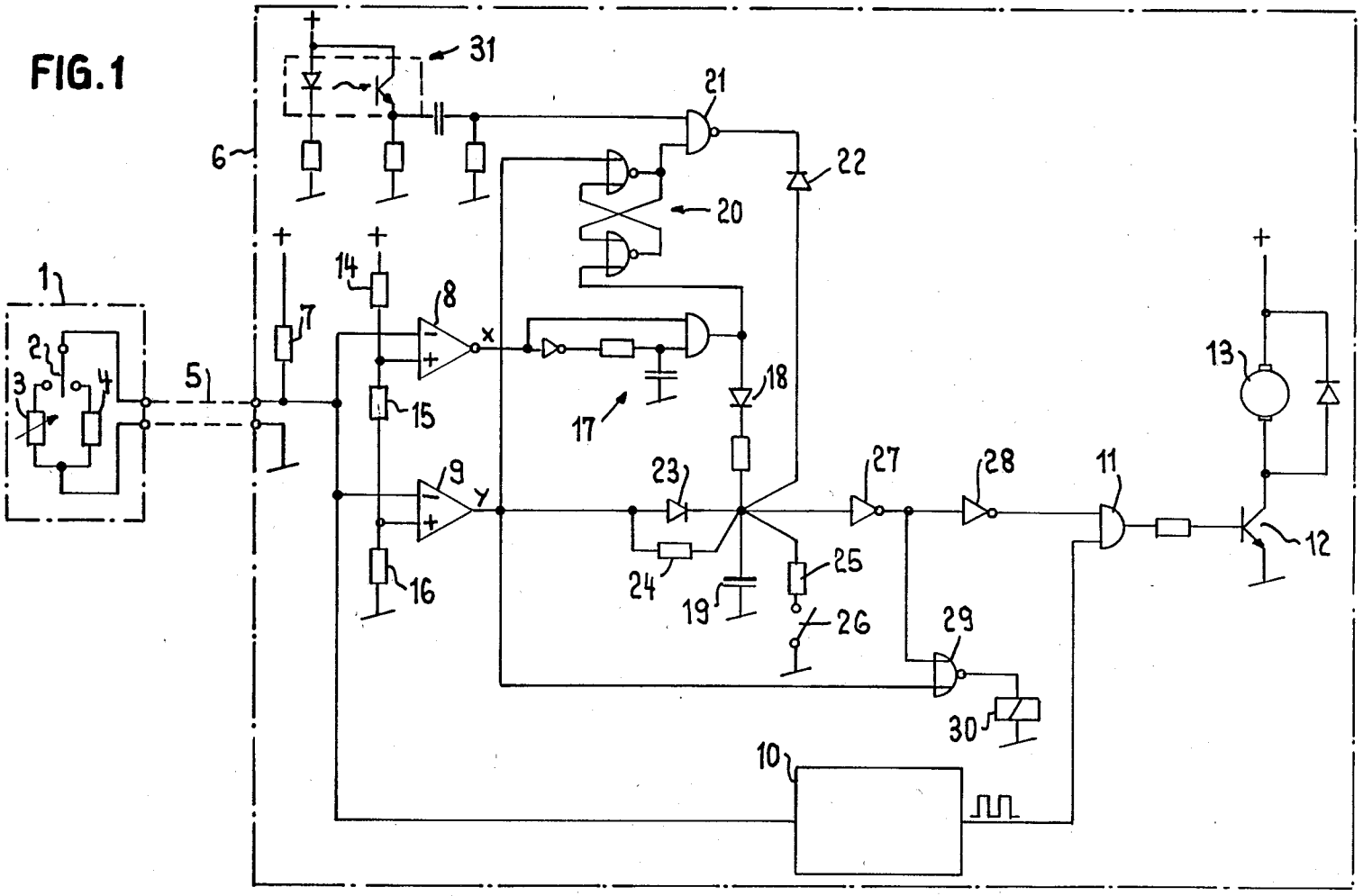
FIG. 1 shows a preferred embodiment of an electric circuit diagram.

FIG. 1 shows schematically the electric circuit of a foot control 1. These circuits comprises a change-over switch 2 which may alternately connect into the circuit a variable resistance 3 or a fixed resistance 4. In the present embodiment, the variable resistance 3 has a maximum value of 4 kOhm and the resistance 4 a value of 10 kOHm. The electric circuit of the foot control 1 is connected by a two wire cable 5 with a control circuit or receiver 6 which may be disposed in the sewing machine. The circuit of the foot control 1 is supplied with a positive potential by means of a resistance 7. In operation, the resistance 7 forms a voltage divider with either the resistance 3 or the resistance 4 and the voltage at the central point of this voltage divider is delivered to one input of each of the differential amplifiers or comparators 8 and 9 and to an input of a pulse modulator 10. The output of the pulse modulator 10 is connected to one input of an AND gate 11 which is connected to the base of a transistor 12 which in turn controls energization of a driving motor 13 in a chopper mode. The comparators 8 and 9 receive, from a voltage divider comprising resistances 14, 15, 16, different reference voltages. The output of the comparator 8 is connected, through a differentiating circuit 17 and a diode 18, with a capacitor 19. The output of the differentiating circuit 17 as well as the output of the comparator 9 are connected to inputs of a flip-flop 20, the output of which is connected to an input of a NAND gate 21. The output of this NAND gate is connected through a diode 22 with the capacitor 19. The output of the comparator 9 is also connected, through a diode 23 and a parallel resistance 24, to the capacitor 19. This capacitor 19 may be discharged by a resistance 25 and a switch 26. The switch 26 is closed when the upper shaft of the machine is stopped in a position corresponding to the upper stop position of the sewing machine needle as described below. The capacitor 19 is connected, through a Schmidt trigger 27 and an inverter 28, with another input of the AND gate 11. The outputs of the Schmidt trigger 27 and the comparator 9 are connected to NOR gate 29, the output of which drives a stopping magnet 30 for stopping an upper shaft of the sewing machine needle as described below. A photodetector 31, preferably comprising a photodiode and a phototransistor, is connected to another input of NAND gate 21. The control of this photodetector is explained below.

Figure 2:
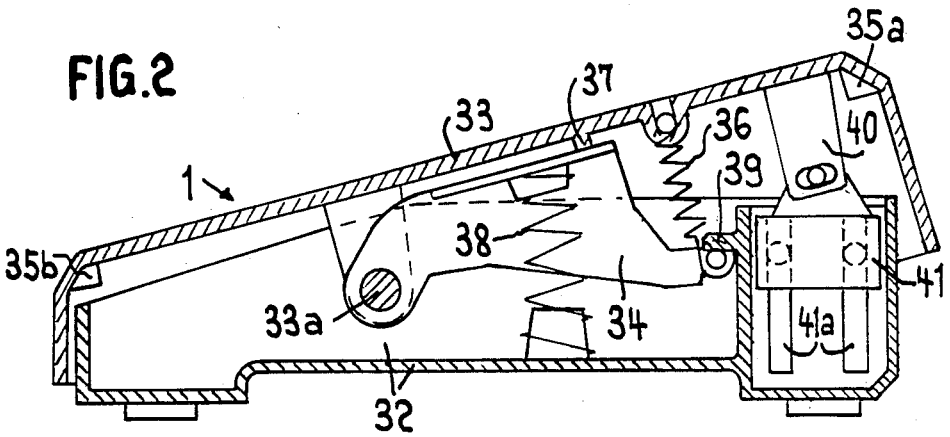
FIGS. 2 and 3 show respectively the foot control in its off position and in its active position for selecting the stop position of the needle.
Figure 4:
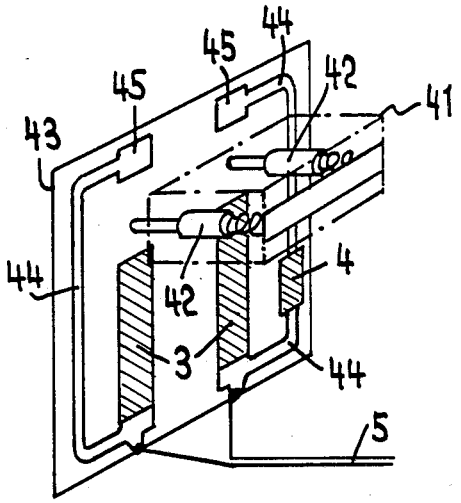
FIG. 4 shows the electric parts of the foot control.

FIG. 2 shows an exemplary foot control 1 for use in the circuit of FIG. 1. The foot control 1 comprises a frame 32 in which a pedal 33 and a lever 34 are slewably mounted on a shaft 33*a*. Stop tappets 35*a* and 35*b* on the pedal determine the end positions of the horizontal swing of the pedal 33 in the clockwise and counter-clockwise directions respectively. A tension spring 36 is positioned between a free end of the lever 34 and the pedal 33. This spring 36 acts to hold the lever 34 in contact with a tappet 37 on the pedal 33. A compression spring 38 is positioned between the bottom of the frame 32 and the lever 34. This spring 38 tends to hold the pedal 33 in a neutral position, as shown in FIG. 2, in which the free end of the lever 34 is in contact with a stop 39 of the case 32. The pedal 33 is supported by the base 32 via a slip connection 40 and a slide 41 by means of which the pedal 33 may be shifted in a vertical direction along guides 41*a*. This slide 41 is schematically illustrated in FIG. 4. As illustrated in FIG. 4, the slide 41 preferably supports two spring loaded brushes 42. These brushes are pressed against a thick film substrate 43 comprising conducting tracks 44 with contacts 45. The resistance 4 and the two resistive layers 3 respectively corresponding to the resistor 4 and variable resistor 3 of FIG. 1 are disposed in the conducting tracks 44. In the position illustrated in FIG. 4 the brushes 42 are between the resistive layers 3 and the If the slide 41 with the brushes 42 is shifted upward, the brushes 42 contact the contacts 45 which switches the resistance 4 into the circuit. Displacment of the brushes 42 downward causes the brushes 42 to contact the resistive layers 3, thereby switching the resistance 3 of FIG. 1 into the circuit. The resistance value of resistance 3 varies with the vertical position of the slide 41 which carries the brushes 42.

Figure 5:
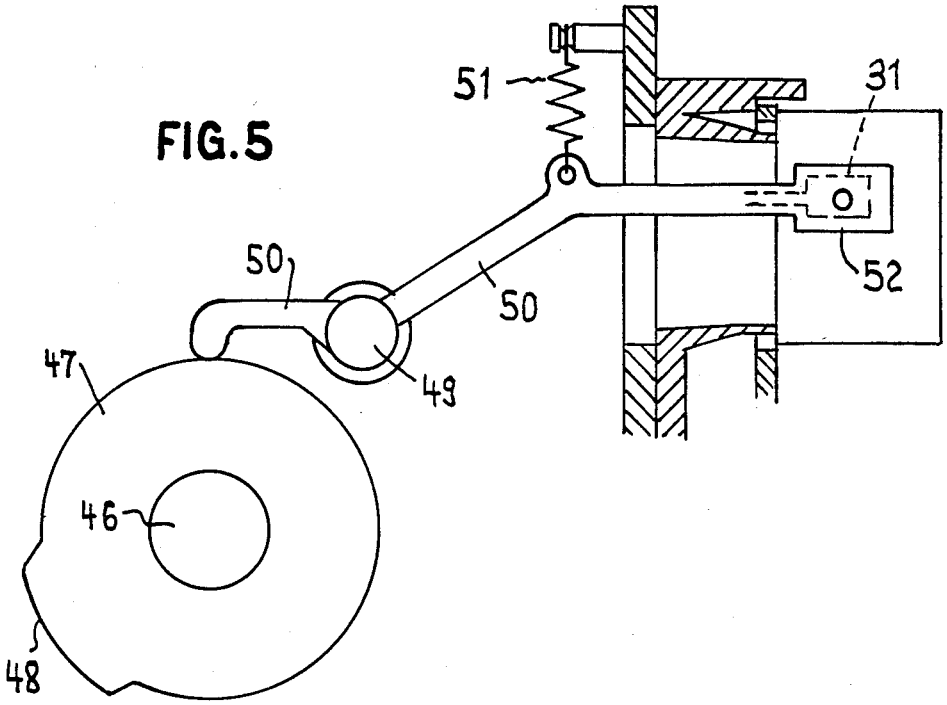
FIG. 5 shows a position encoder.

FIG. 5 shows the position encoder. A cam 47 with tappet 48 is fixed on an upper shaft 46 of the sewing machine. The cam 47 acts on a lever 50 slewable around a shaft 49. The lever 50 is pressed against the cam by a tension spring 51. The free end of the lever 50 is preferably in form of a light barrier 52 which in the illustrated position interrupts a light ray of the photodetector 31. If the lever 50 is swung clockwise by the tappet 48, the light barrier 52 opens and a phototransistor in the photodetector 31 becomes conducting.

Figure 6:
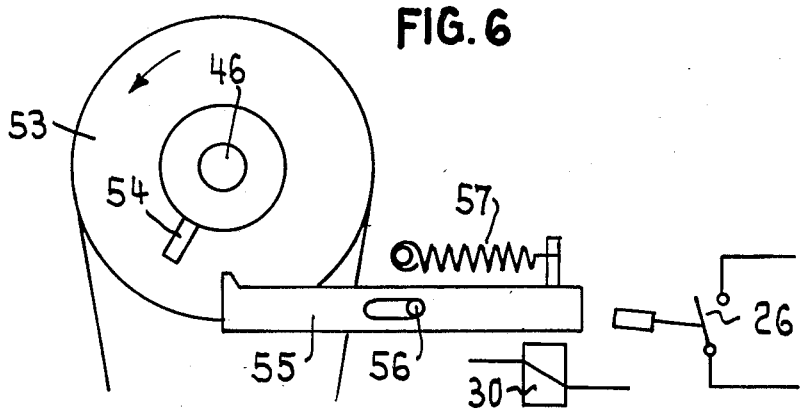
FIG. 6 shows a stopping device for stopping the needle in its upper stop position.

FIG. 6 shows schematically the stopping device for determining the stop position of the upper shaft 46 of the sewing machine needle. A pulley 53 which drives the upper shaft 46 is mounted thereon by means of a spring coupling. A stopping device of this kind is described in DE-OS No. 30 17 176. A sleeve with a stopping tappet 54 is disposed over the coupling. A stopping lever 55 may be pivoted on a pin 56 into the path of the stopping tappet by means of a magnet 30 in order to stop the upper shaft 46 in a predetermined position. At this predetermined position, the needle is in its upper position over the sewing material and the thread lever is also in its uppermost position. When the stopping tappet 54 comes in contact with the stopping lever 55, the latter is displaced to the right, as viewed in FIG. 6, with respect to the pin 56 against the action of a tension spring 57 until it actuates a switch 26. The above-described mechanism works as follows:

For sewing, the pedal 33 is swung forward to thereby pivot in the clockwise direction of FIG. 2 so that the slide 41 moves downward and the brushes come in contact with the layers of the resistance 3. The value of the resistance has maximum 4 kOhm so that a relatively small voltage appears at the inputs of the comparators 8 and 9. The two comparators then produce a positive output signal. The capacitor 19 is charged through the diode 23. The Schmidt trigger 27 is switched on and a signal is inputted to gate 11 through the inverter 28, so that the pulses of the pulse modulator 35 are delivered to the transistor 12 and the motor 13 is driven. The length of the pulses increases when the input signal decreases and the number of turns of the motor increases. If the foot control is let loose, it comes back to its neutral position illustrated in FIG. 2 and the driving circuit is interrupted. The voltage at the inputs of the comparators 8 and 9 increases to the full voltage, i.e., to a value above the reference voltages and the outputs X and Y of the two comparators go to zero, thus discharging the capacitor 19 through the resistance 24. The time delay which results from the discharge of the capacitor 19 is utilized for further driving the upper shaft and for positioning it so that the needle comes to rest over the sewing material. At the same time the stopping magnet 30 is activated through the gate 29. As described above, the upper shaft is then secured in a predetermined stopping position and at the same time the switch 26 is closed. This produces a rapid discharge of the capacitor 19 through the resistance 25 and the gate 11 is blocked through the Schmidt trigger 27 and the inverter 28 so that the transistor 12 is blocked and the motor 13 receives no current. After the discharge of capacitor 19, the stopping magnet 30 is switched out by the Schmidt trigger 27 and the gate 29.

Figure 3:
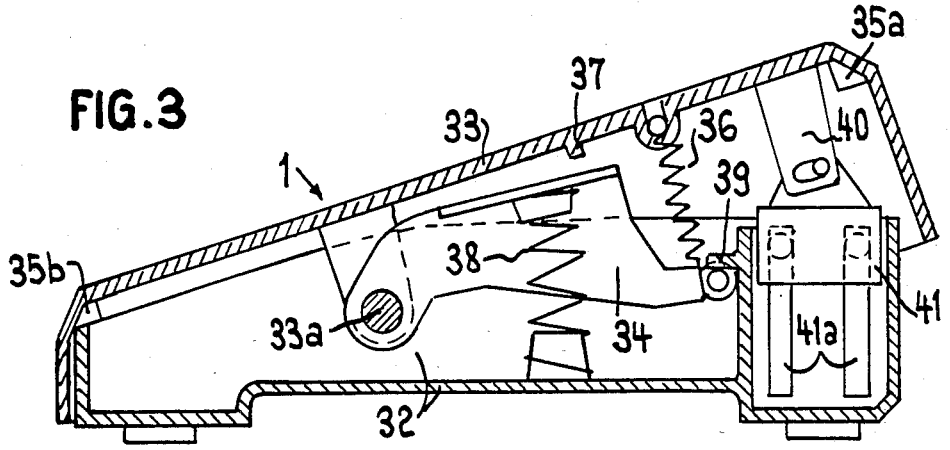

When the sewing machine is stopped by releasing the foot control, the needle is automatically stopped in its upper position. It could however be desired in some instances, e.g., for turning the sewing material or before the beginning of the operation of sewing, to introduce the needle into the sewing material, that is to displace the needle to its bottom position. To this end the foot control 33 is actuated backwards in the counter-clockwise direction to the stopping position of FIG. 3. The foot control is then lifted off from the lever 34 against the action of the spring 36, the slide 41 with its brushes is displaced upward until the brushes 42 contact the contacts 45. This switches in the curcuit having the resistance 4. The voltage at the inputs of the comparators 8 and 9 is then smaller than the reference voltage of the comparator 8 but greater than the reference voltage of the comparator 9. At output X of comparator 8 there appears the logic signal 1 and at output Y of the comparator 9 the logic signal remains at zero. At the time of appearance of the positive going edge of the signal at the output X, the differentiating circuit 17 and the diode 18 produce a pulse which charges the capacitor 19. This charging of capacitor 19 switches on the motor 13 which is driven until the needle reaches its bottom position in which the light barrier 52 of the photodetector 31 is open so that the transistor of the latter is illuminated. This produces an increase of the voltage at the input of gate 21 which is connected with the photodetector and the pulse thus produced discharges the capacitor 19 through the diode 22 and the gate 21. This stops the motor.

When the pedal of the foot control is set loose and again actuated the motor is again switched on as described above while the magnet 30 is activated through the gate 29 which produces the stopping of the upper shaft 46 as described above by abutment of the stopping tappet 54 against the stopping lever 55 so that the needle is stopped in its upper stop position. The switch 26 is then closed and it discharges the capacitor 19 through the resistance 25 which switches off the motor. By repetitive backward actuations of the foot control, the needle is thus alternatively positioned in its upper and bottom positions. The flip-flop 20 prevents the discharge of the capacitor 19 by the pulse of the photodetector 31 when afterward the pedal is actuated forward. The flip-flop 20 is set when the comparator 9 produces a logic signal 1 at its output Y and it is reset when only the logic signal 1 appears at the output X of comparator 8. When the flip-flop 20 is set, any pulses from the photodetector are blocked by gate 21.

Figure 7:
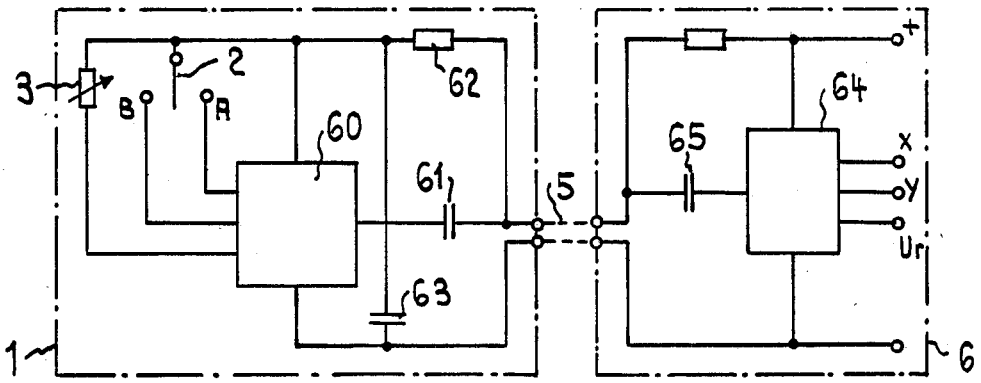
FIG. 7 shows a second embodiment of the circuit of FIG. 1.

FIG. 7 shows another embodiment of the invention in which the signals from the foot control 1 are transmitted to the receiver 6 in the sewing machine as an AC voltage superimposed on the DC supply voltage. As before, the foot control preferably comprises a variable resistance 3 as well as a change over switch 2 actuated by the position of the pedal. When the resistance 3 for the regulation of the motor speed is effective, the change-over switch 2 contacts terminal A. The change-over switch 2 contacts terminal B when the pedal is turned backward. The terminals A and B as well as the resistance 3 are connected to inputs of a frequency modulator 60 the output of which is connected to the two wire cable 5 through a capacitor 61. Power is supplied through the cable 5 and a filter resistance 62 followed by a filter capacitor 63. The receiver circuit 6 comprises a demodulator 64 which receives an AC voltage from the cable 5 by means of a capacitor 65. If the change-over switch 2 is in the illustrated neutral position, the modulator 60 is ineffective; no AC voltage is transmitted and the outputs X and Y of the demodulator 64 produce logic signals of zero. When the resistance 3 is switched in, i.e., the change-over switch 2 is in position A, a range of frequencies is produced for which the demodulator 64 delivers logic signals 1 at the X and Y outputs, while it delivers at a third output a control voltage Ur for the pulse modulator 10. When the foot control is actuated backward, the change-over switch 2 assumes position B and the modulator 60 produces a frequency for which the demodulator 64 delivers the logic signals 1 and 0 at it X and Y outputs respectively. This produces, as described above, the alternate positioning of the needle from one stop position to the other stop position.

The circuit could be made somewhat simpler when no continuous changing over between the two stop positions of the needle is desired. In this case, the needle would automatically stop in its upper stop position when the machine is stopped, as described above. By means of an additional signal the ability to drive the needle from its upper stop position to another position could be provided. Alternatively, the number of comparators and the number of voltage states at their outputs can be increased in order to provide for further combinations of logic information. It would then be possible to transmit, in the simple manner described on a two-wire cable, further information corresponding to a plurality of functions to be driven, e.g., further positions of the needle, a thread cutting device or similar function. However, this would require positioning the foot control in a corresponding number of well-defined predetermined positions.

We claim:

1. A sewing machine having an electric driving motor, a needle and a foot control for regulating sewing speed and for selecting at least one needle stop position, said foot control having a range of regulation for which a regulating signal for determining the sewing speed is produced and an off position for which a switch off signal, different from the regulating signal, is produced, a receiver for receiving the regulating signal and switch off signal, said receiver being operable upon receipt of said switch off signal, to control the needle in said at least one needle stop position, said foot control having at least one control position for producing a control signal different from the regulating signal and the switch off signal, said foot control comprising a change over switch commutable between end positions for producing output signals, corresponding to the control signal and the regulating signal, to the receiver, said control signal having a voltage range outside a voltage range of the regulating signal, the receiver comprising logic circuits with at least two comparator circuits each having different actuation levels for producing a combination of logic signals corresponding to the received signals, said combination of logic signals defining at least three predetermined logic conditions, each of said logic conditions determining a function, and a two wire connection for transmitting signals between the foot control and the receiver.

2. The sewing machine according to claim 1, wherein said foot control comprises a pivotally supported pedal said pedal being pivotable between a neutral stop position and a control position for producing said control signal.

3. The sewing machine according to claim 1, wherein the foot control comprises a pedal, and a slide connected to the pedal, at least one brush electrically connected to said slide, and first and second resistive members, said brush being displaceable from a central position electrically isolated from said first and second resistive members in a first direction for contacting said first resistive member and producing said regulating signal and in a second direction for contacting said second resistive member and producing said control signal.

4. The sewing machine according to claim 3, wherein the foot control comprises a substrate having at least one contact formed thereon electrically connected to said first resistive member and wherein said first and second resistive member respectively comprise a thick film resistance formed on said substrate, and wherein said brush is operable to slide on the substrate between said contact and said second resistive member thick film resistance.

5. The sewing machine according to claim 1, wherein the needle is controllable between an upper stop position and a bottom stop position by means of said control signal.

6. The sewing machine according to claim 5, wherein displacement of the needle from one of said stop positions to the other of said stop positions is controlled by repetitive control signals.

7. The sewing machine according to claim 1, further comprising a stopping magnet and means for activating said stopping magnet whenever power to said driving motor is interrupted, said sewing machine further comprising an upper shaft having an associated stop abutment for stopping said upper shaft in a predetermined position at which the needle is in an upper stop position, and a driving motor circuit breaker operable to be actuated whenever the upper shaft abuts against the stop.

8. The sewing machine according to claim 7, further comprising a photodetector responsive to the position of said upper shaft for switching off the driving motor when said upper shaft is in a position corresponding to a bottom stop position of the needle.

9. The sewing machine according to claim 8, further comprising an auxiliary circuit for overriding the photodetector whenever the regulating signal is effective.

10. The sewing machine of claim 2 further comprising means for determining pivot limits of said pedal and a stop means for determining said neutral stop position.

11. The sewing machine of claim 10 wherein said pedal is operable to pivot about a pin and further comprising a lever pivotally connected at one end thereof to said pin and resilienty connected at a second end thereof to said pedal, wherein said stop means comprises (a) a limit stop disposed in an abutting relationship with said second end of said lever, and (b) said resilient connection.

12. A sewing machine having an electric driving motor, a needle, and a foot control for regulating sewing speed and for selecting at least one needle stop position, said foot control having a range of regulation for which a regulating signal for determining the sewing speed is produced and an off position for which a switch off signal, different from the regulating signal, is produced, a receiver for receiving the regulating signal and switch off signal, said receiver being operable upon receipt of said switch off signal, to control the needle in said at least one needle stop position, said foot control having at least one control position for producing a control signal different from the regulating signal and the switch off signal, and a two wire connection for transmitting signals between the foot control and the receiver, said foot control further comprising an oscillator, the frequency of which is variable within a range of adjustment, said oscillator being operable by said change over switch to produce a signal having a frequency characterizing the control signal, and means for superimposing the frequency of the oscillator signal on the two wire connection of the foot control, and wherein the receiver comprises logic circuits and a demodulator, outputs of which deliver a combination of logic signals corresponding to the frequency of the oscillator signal for regulating the driving motor, and a logic signal for the logic circuits, said combination of logic signals defining at least three predetermined logic conditions, each of said logic conditions determining a function.

13. The sewing machine according to claim 12, wherein said foot control comprises a pivotally supported pedal, said pedal being pivotable between a neutral stop position and a control position for producing said control signal.

14. The sewing machine according to claim 12, wherein the foot control comprises a pedal and a slide connected to the pedal, at least one brush electrically connected to said slide, and first and second resistive members, said brush being displaceable from a central position electrically isolated from said first and second resistive members in a first direction for contacting said first resistive member and producing said regulating signal and in a second direction for contacting said second resistive member and producing said control signal.

15. The sewing machine according to claim 14, wherein the foot control comprises a substrate having at least one contact formed thereon electrically connected to said first resistive member and wherein said first and second resistive member respectively comprises a thick film resistance formed on said substrate, and wherein said brush is operable to slide on the substrate between said contact and said second resistive member thick film resistance.

16. The sewing machine according to claim 12, wherein the needle is controllable between an upper stop position and a bottom stop position by means of said control signal.

17. The sewing machine according to claim 16, wherein displacement of the needle from one of said stop positions to the other of said stop positions is controlled by repetitive control signals.

18. The sewing machine according to claim 12, further comprising a stopping magnet and means for activating said stopping magnet whenever power to said driving motor is interrupted, said sewing machine further comprising an upper shaft having an associated stop abutment for stopping said upper shaft in a predetermined position at which the needle is in an upper stop position, and a driving motor circuit breaker operable to be actuated whenever the upper shaft abuts against the stop.

19. The sewing machine according to claim 18, further comprising a photodetector responsive to the position of said upper shaft for switching off the driving motor when said upper shaft is in a position corresponding to a bottom stop position of the needle.

20. The sewing machine according to claim 19, further comprising an auxiliary circuit for overriding the photodetector whenever the regulating signal is effective.

21. The sewing machine according to claim 13, further comprising means for determining pivot limits of said pedal and a stop means for determining said neutral stop position.

22. The sewing machine according to claim 21, wherein said pedal is operable to pivot about a pin and further comprising a lever pivotally connected at one end thereof to said pin and resiliently connected at a second end thereof to said pedal, wherein said stop means comprises (a) a limit stop disposed in an abutting relationship with said second end of said lever, and (b) said resilient connection.

* * * * *